US006611205B2

(12) United States Patent
Guthrie et al.

(10) Patent No.: US 6,611,205 B2
(45) Date of Patent: Aug. 26, 2003

(54) GATE OPERATOR SAFETY SYSTEM

(75) Inventors: David C. Guthrie, Chester Springs, PA (US); Charles P. Coggins, Downingtown, PA (US)

(73) Assignee: Allstar Corporation, Downingtown, PA (US)

( * ) Notice: Subject to any disclaimer, the term of this patent is extended or adjusted under 35 U.S.C. 154(b) by 0 days.

(21) Appl. No.: 10/161,724

(22) Filed: Jun. 5, 2002

(65) Prior Publication Data

US 2002/0186130 A1 Dec. 12, 2002

Related U.S. Application Data

(60) Provisional application No. 60/296,462, filed on Jun. 8, 2001.

(51) Int. Cl.[7] ..... G08B 1/08

(52) U.S. Cl. ..... 340/539; 340/545.1; 340/564; 340/825.69; 49/26

(58) Field of Search ..... 340/539, 679, 340/545.1, 439, 908.1, 928, 5.7, 5.71, 825.69, 825.72, 564, 686.6; 49/324, 25, 26, 31

(56) References Cited

U.S. PATENT DOCUMENTS 4,360,801 A * 11/1982 Duhame ..... 340/521
4,416,085 A * 11/1983 Lybecker et al. ..... 49/340
4,464,651 A * 8/1984 Duhame ..... 340/521
4,658,543 A * 4/1987 Carr ..... 49/139
4,808,995 A * 2/1989 Clark et al. ..... 340/5.64
4,847,542 A * 7/1989 Clark et al. ..... 318/560
RE35,364 E 10/1996 Heitschel et al. ..... 700/90
5,576,701 A * 11/1996 Heitschel et al. ..... 340/5.31
5,751,224 A 5/1998 Fitzgibbon ..... 340/825
6,049,289 A 4/2000 Waggamon et al. ..... 340/825
6,326,751 B1 * 12/2001 Mullet et al. ..... 318/434

* cited by examiner

*Primary Examiner*—Daniel J. Wu
*Assistant Examiner*—Phung T Nguyen
(74) *Attorney, Agent, or Firm*—Gregory J. Gore

(57) ABSTRACT

An emergency control system for opening or closing a gate resides within a controller for regulating operation of the opening/closing mechanism of the gate. A safety station is in communication with the controller and includes means to signal the emergency control circuit to open or close the gate by using either of two pushbutton switches. Sensing means which detect an unsafe condition in the area of the gate such as human entrapment is connected to the controller and initiates an alarm mode operation of the controller when an unsafe condition is detected and turns on a sound alarm. Pushing either of the safety button switches turns off the sound alarm and moves the gate. Movement of the gate is stopped if the pressed button is released while the gate is in motion which otherwise continues to its limit. The emergency control circuit is responsive to input signals from the safety station only when the controller is in the alarm mode.

8 Claims, 4 Drawing Sheets

GATE OPERATOR SAFETY SYSTEM

Priority based upon provisional application Ser. No. 60/296,462 filed on Jun. 8, 2001, entitled "GATE OPERATOR SAFETY SYSTEM" is hereby claimed.

FIELD OF THE INVENTION

This invention relates to gate or door opening devices which control the entry and exit for personnel and vehicles from closed spaces. More particularly, it relates to electromechanically operated gates which utilize entry/exit control devices that signal the opening and closing of the gate.

BACKGROUND OF THE INVENTION

Residential, commercial, industrial, governmental and other facilities fence the perimeter or other portions of their properties for security and/or safety issues. To be practical, provisions must be made for vehicular and/or personal access to the fenced-in area. Typically some type of gate is used to restrict access to an opening in the fence. The opening in the fence and the gate are sized appropriately for the type of access required by the facility. There are many different types of gates, however most slide or swing in some fashion out of the opening in the fence.

The gate may be moved out of the fence opening either manually or by a motorized device called a gate operator or gate motor which must typically provide vehicular access. Manual operation requires a guard or attendant to stand watch and open and close the gate as required, or an occupant of the vehicle to open and close the gate. This can be costly and/or inconvenient especially in inclement weather. In addition, some people may find it difficult or impossible to move the gate due to its physical size and mass. Motorized gate operators can be used to avoid the problems associated with manual gate operation.

Gate operators are designed to provide the mechanical force required to move the gate out of the fence opening, thus eliminating the need for a person to physically move the gate. This is usually accomplished as follows. Some type of electric motor (DC or AC) is attached to a mechanical or hydraulic drive system. The final output of the drive system provides the required amount of force at a given speed to move the gate. The final output of the drive system is attached by mechanical means to the gate. Typical mechanical attachments are sprocket and chain for slide gates and articulated arm mechanisms for swing gates. A control circuit starts and stops the motor in response to user inputs such as pushbuttons, timers, limits switches, internal and external safety devices to detect entrapment, and other devices or operational conditions under which the control circuit performs a predefined series of motor start and stop operations. The gate, gate operator, and external devices must function together as a system to provide the desired access.

The control circuit of a gate operator typically has provisions for the connection of user controls or entry/exit control devices. User entry/exit control devices include pushbuttons, radio controls, card readers, keypads, loop detectors, phone systems, or similar devices. Entry/exit devices typically allow vehicular access without requiring an occupant to get out of the vehicle to activate the gate operator in the same manner. A typical gate control circuit provides the ability through the activation of a user entry/exit device to move the gate open or closed, to stop a moving gate, to stop and reverse a closing gate, and to prevent an open gate from closing.

Because gates are large and heavy gate operators can generate large forces, there is a need to guard against personal injury due to entrapment. Because of the many different types of gates and installations, there are many potential entrapment zones in a typical installed gate and gate operator system.

Unlike garage doors where the entrapment zone is well-defined, every gate and gate operator system needs to be evaluated for its own unique entrapment zones, and conditions and different installations warrant different entrapment protection devices. Entrapment may occur in both closed and open directions and each must be addressed. The gate operator control circuit must accommodate various external devices. Traditionally, external entrapment detection devices such as electric edge sensors or photoelectric sensors have been connected to the gate operator control circuit parallel with the user entry/exit devices.

In addition to the external devices, the control circuit may use some type of internal detection system such as a current sensor or rotational/speed sensor. These systems may be adjustable to compensate for various gate and installation conditions and typically operate independently from external devices. Thus, gate operators are faced with a difficult task: close the gate to secure the property and prevent unauthorized access while detecting potential entrapments and minimizing personal injury.

Until the Underwrites Laboratories Standard UL325 was revised and published in 1998, there were no specific requirements for gate operators and their entrapment detection provisions, or how the gate operator was to respond to the various types of entrapment detection devices. In the revision, UL defined installation classes and the minimum entrapment detection provisions for each class, and the response of the gate operator to the various types of entrapment detection devices.

One of the provisions of the UL325 Standard requires the gate operator to stop and sound an alarm whenever certain sequences of entrapment detection are sensed by the control circuit and activated. In this state (hereinafter referred to as the "alarm mode") it is assumed there is an entrapment and further movement of the gate could cause personal injury. Thereafter, the gate operator may only be activated by a device that is wired to the operator and within the line of sight of the gate system. Devices such as radio controls, loop detectors or entry systems may not be used to reactivate the gate operator. Once in the "alarm mode" the gate operator may resume normal operation after reaching either an open or close limit after activation by a hardwired device as described above or a power-reset.

The wired entrapment safety station that is within the line of sight of the gate system poses a security or safety dilemma to the gate system installer and end user. A regular pushbutton may be used for the alarm mode activation, however it is active and accessible to anyone at all times and the security of the installation may be compromised. If a keyed or locked pushbutton station is used, then a key will be required for operation even in an emergency situation. This is a safety concern since it may be imperative to move the gate quickly to relieve an entrapment. The UL Standard allows the use of a reset button, however after reset, all devices connected to the gate operator may be used to activate the gate operator. Under this scenario, after reset, someone out of sight of the gate system, using a radio control for example, may be able to reactivate the gate operator in a direction that could cause additional injury.

To summarize the problem, a sequence of events such as an entrapment will cause the control logic of the gate operator to enter an alarm mode. When in alarm mode, the gate operator can only be activated by some hardwired device that is in the line of sight of the gate. To be useful as a safety device, the hardwired device (hereinafter referred to as safety station) must be accessible to the general public, however since it is accessible to the general public, it compromises the security of the installation. Hence, there is a need in the art for a safety device which meets UL standards but which does not compromise safety or security of the installation.

SUMMARY OF THE INVENTION

To solve this problem, the present safety operating system has been devised which employs an emergency control circuit within the controller which receives signals from a safety device. When the gate operator is working properly, any device connected to the safety device inputs to the emergency control circuit is ignored by the control circuit and is effectively disabled. Thus, the safety station device connected to the control circuit inputs will not activate the gate operator under normal conditions. But when the gate operator is in the alarm mode, these inputs to the control circuit are no longer ignored by the control circuit and the safety station device connected to these inputs is enabled. Hence, the safety station device connected to the control circuit inputs will only activate the gate operator in the alarm mode. When the control circuit terminates the alarm mode the control circuit will once again ignore the input from the safety station device. Note that a "stop" command is not included in this function which, if available as an input, should always be active.

More specifically, the applicant has devised an emergency control system for opening or closing a gate which includes a mechanism for moving the gate between open and closed positions, a controller for regulating operation of the gate mechanism, and a user radio control device for signaling the controller to open and close the gate. A safety station is in communication with the controller and includes means to signal the emergency control circuit to open or close the gate by using two pushbutton switches. Sensing means is connected to the controller to detect an unsafe condition such as human entrapment in the gate area. When an unsafe condition is detected, an alarm mode operation of the controller is initiated and a sound alarm is turned on. The sound alarm is turned off when either of the safety station buttons is first pressed. The controller is programmed such that once the gate is moved by pressing one of the safety station pushbutton switches, the gate operator is signaled to stop movement if the pressed button is released while the gate is in motion. An emergency control circuit in the controller is responsive to input signals from the safety station only when the controller is in the alarm mode. Other operational characteristics and advantages of the invention will be apparent to those of skill in the art from the following drawings and description of the preferred embodiment of the invention.

DESCRIPTION OF THE PREFERRED EMBODIMENT

Figure 1:
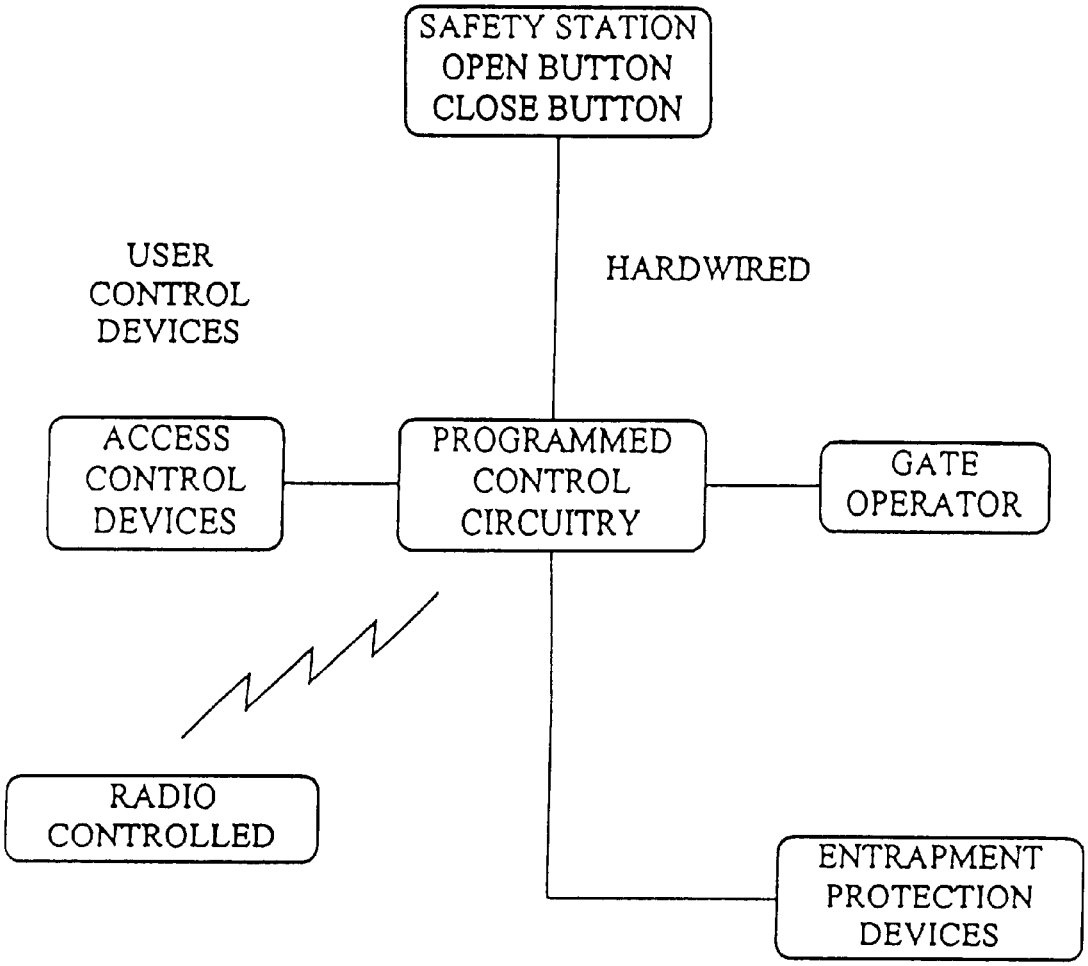
FIG. 1 is a diagram showing the basic components of the invention.

Referring now to FIG. 1, basic components of the present invention are shown. An operating system controller is wired directly to the gate operator which opens and closes the gate. A safety station is hardwired to the controller within sight of the gate and includes simple open and close pushbuttons. A radio-controlled user command module or other access control devices may be used at all times during normal operation to activate the gate as desired. In addition, an access control device such as a "free exit" hardwired station may also be included to open the gate from inside the confined area to supplement the radio-controlled user command module. An entrapment sensor is wired to the controller to detect the unsafe condition in the area of the gate. The sensor means may include any appropriate sensing means such as pressure sensing means along the edge of the gate or a photoelectric device. The detection of an entrapment by the sensor initiates the controller alarm mode. Other access control devices may also be connected to the control circuit.

Figure 2:
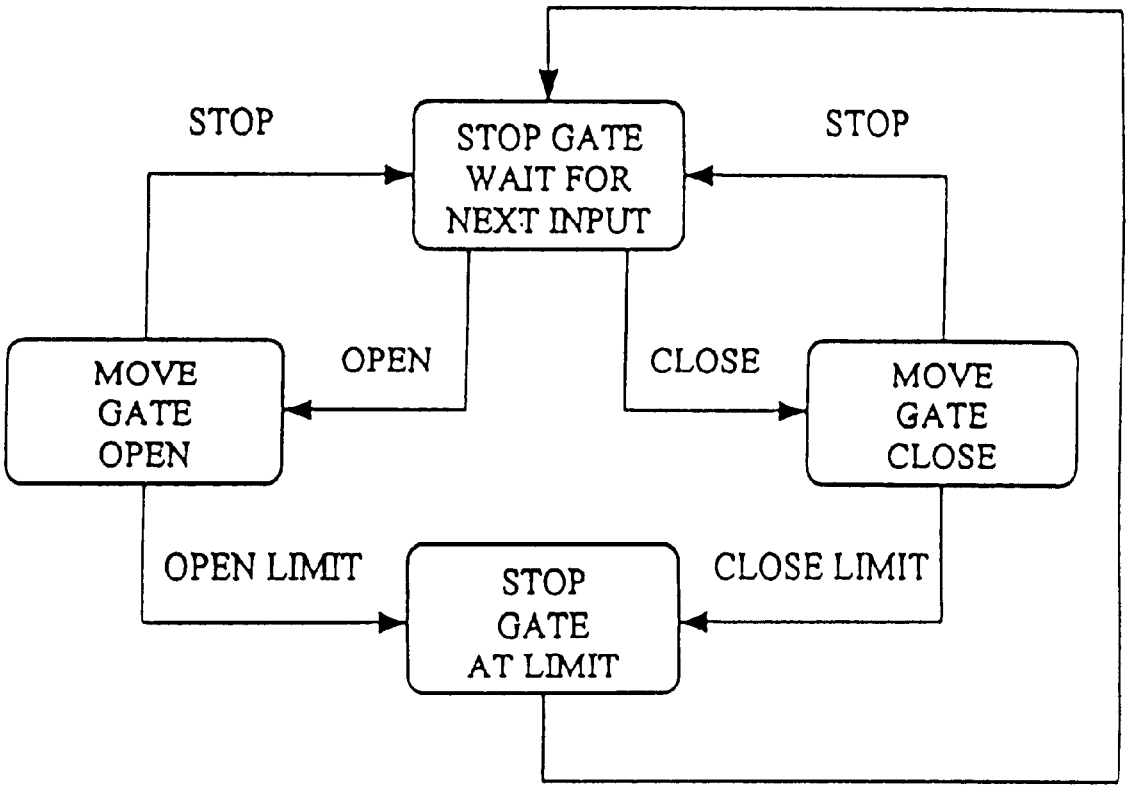
FIG. 2 is a logic chart for a gate operator showing normal operation that is used in conjunction with the present invention.

FIG. 2 depicts normal operation of a gate operator system used in conjunction with the present invention. The gate may be at rest at some point between the limits. The control circuit waits for a command to open or a command to close. Upon receiving such a command, the control will start the gate in motion. If no other commands are received, the gate will continue until either the open or the close limit is reached. Upon reaching a limit or receiving an additional command, the gate control will stop the gate and wait for another command. If there are multiple activations of the entrapment protection devices during the open or close movement of the gate before a limit is reached, the alarm mode is initiated.

Figure 3:
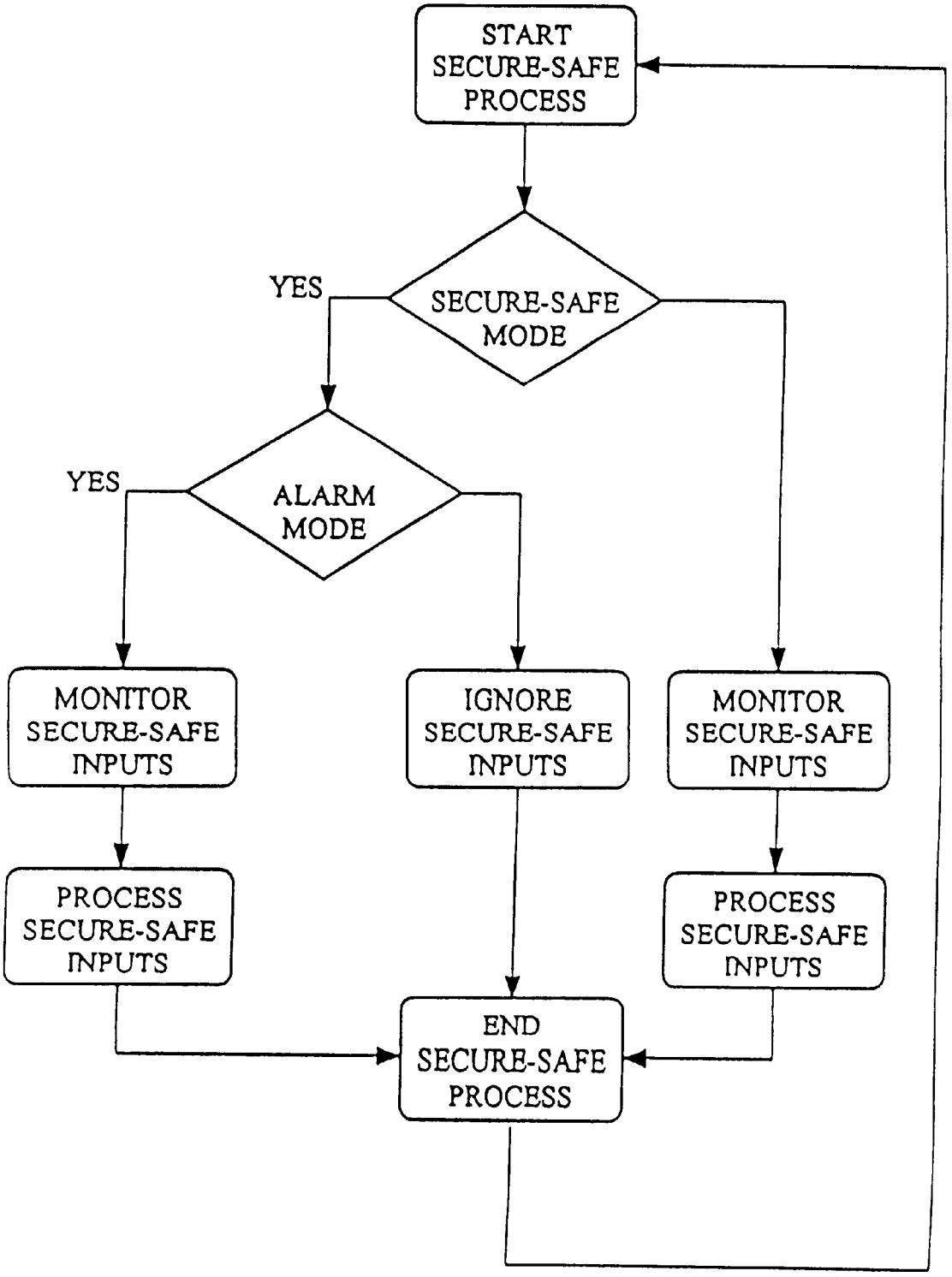
FIG. 3 is an overall operating system logic chart of the invention.

Referring now to FIG. 3, a logic process chart is shown which generally depicts the overall operation of the present invention. The invention is implemented via a software algorithm in the microprocessor controlled gate control circuit. For the purposes of FIGS. 3 and 4, the chart labels refer to the operating system of the present invention as "Secure-Safe". The algorithm first determines if the safety system operation mode has been enabled. The installer/user enables this feature by changing a switch setting on the control circuit. When the algorithm detects the switch change, the safety mode is enabled. Next, the algorithm determines the current operating conditions of the gate operator. If the condition is normal, the algorithm will ignore any signal present on the safety station device inputs from the safety station. If an alarm mode condition exists, the algorithm will respond to any signal present on the safety station device inputs.

The first actuation of the open or close button of the safety station connected to the inputs will only reset (turn off) the alarm. The system will not start the gate into motion until either button is released and pressed again. Any sequence is valid. For example, pressing the close button will reset the alarm, then the open button can be pressed to start the gate open. The gate will only remain in motion as long as the pushbutton is pressed. This is referred to as "constant pressure" activation. If the pushbutton is released, the gate operator will stop gate movement. The gate must reach an open or closed position before the gate operator resumes normal operation. This adds greater control to the gate operator, especially in a panic situation. If operation were allowed via momentary contact, it would be very easy to activate the gate operator in the wrong direction to relieve the entrapment. Under certain conditions, it may be desirable to move the gate only a small distance to relieve entrapment. This is easily accomplished with constant pressure activation. Further enhancements include implementing a lamp circuit and alarm circuit in the open/close pushbutton station.

Figure 4:
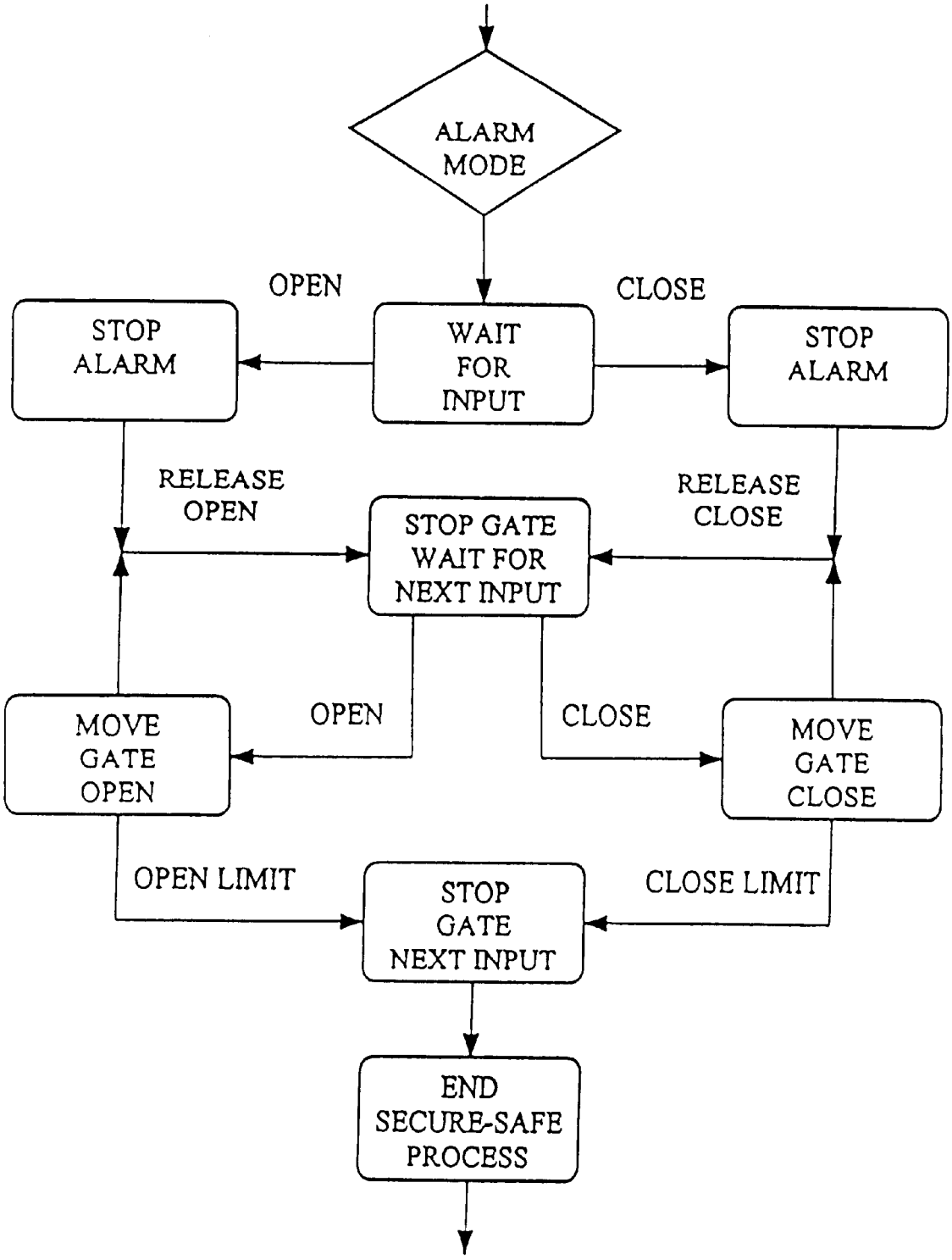
FIG. 4 is a logic chart of the present invention in the alarm mode.

FIG. 4 shows greater detail of the program logic of the present invention when in the alarm mode. Upon receiving a signal, an input from the safety station device when the controller circuitry is in alarm mode, the sound alarm is first terminated when the input from the safety station device indicates whether the gate should open or close. The gate is then moved in the correct direction until its limit is reached and the gate is stopped and the process is completed. As an additional feature, as described below with regard to pushbutton actuation of the safety station device, the gate may intermittently stop before receiving a second input which would initiate the opening or closing of the gate.

A specific example of the benefits of the present invention can be explained as follows. A typical gate system installation consists of a gate and gate operator with a radio control to activate the gate operator to open the gate from outside the fence. A "free exit" station is wired directly to the operator to open the gate from inside the fence. All of these devices only cause the gate operator to open the gate. An auto-close timer may be used to activate the gate operator to close the gate after a predetermined period of time. External entrapment detection devices such as electric edges or photoelectric devices may be installed as part of the system. No other control devices are usually installed. However, in this installation, when a sequence of events such as an entrapment causes the control circuit of the gate operator to enter an alarm mode, there is no simple way to reset the alarm or to activate the gate operator to move away from the entrapment. Someone must disconnect the main power from the gate operator to reset the alarm and allow the gate operator to return to normal operation. However this can cause further complications. After power is restored, someone can unintentionally reactivate the gate operator with a radio control or free exit loop, causing the gate to open. If the original entrapment was in the close direction, the auto-close timer will activate the gate operator to close the gate and potentially inflict additional personal injury.

If a safety operating system of the present invention is added to the typical gate system described above, the alarm mode scenario changes dramatically. An open/close pushbutton safety station is installed within the line of sight of the gate. As described above, the open/close pushbutton station will be non-functional during normal operation. During the alarm mode the open/close station may be used to reset the alarm and to activate the gate operator to move the gate away from the entrapment. Thus, the invention allows quicker response to the situation and complete control over the gate movement.

While described in conjunction with gate systems, the operating system of the invention also has applications to door operator systems. In addition, the present operating system software algorithm could be a permanent feature of a control circuit and could be implemented with the discrete electronics, custom electronics, relays and other electromechanical devices could be added as an option. There may be other modifications or enhancements of the present invention that will be apparent to one of ordinary skill in the art. The specific embodiments disclosed herein are intended only to be exemplary. It should be understood that the safety station may be in communication with the controller by radio or infrared signal as well as being hardwired. Other uses, advantages, and modifications to the present invention will be readily obvious to those of skill in the art, however, the present invention shall be limited only by the following claims and their legal equivalents.

What is claimed is:

1. An emergency control system for opening or closing a gate, comprising:

a gate operator having a mechanism for moving a gate between open and closed positions;

a controller for regulating the operation of said gate operator;

a user control device for signaling said controller to open or to close said gate;

a safety station in communication with said controller, said safety station including means to signal said control circuit to open or to close said gate;

sensing means connected to said controller for detecting an unsafe condition in the area of said gate and for initiating an alarm mode operation of said controller when said unsafe condition is detected; and said controller including an emergency control circuit which disables input signals from said safety station when said controller is not in the alarm mode.

2. The apparatus of claim 1 wherein said user control device is a radio control device.

3. The apparatus of claim 1 wherein said safety station includes two switches, a first switch to signal said controller to close the gate and a second switch to signal said controller to open the gate.

4. The apparatus of claim 3 wherein said first switch and said second switch are both pushbutton switches.

5. The apparatus of claim 4 further described in that said controller is programmed such that when said gate is moved by pressing one of said safety station pushbutton switches, the gate operator is signaled to stop movement of the gate if the pressed button is released while the gate is in motion.

6. The apparatus of claim 5 further including a sound alarm connected to said emergency control circuit such that said sound alarm is turned on when an unsafe condition is detected by said sensing means.

7. The apparatus of claim 6 wherein said sound alarm is turned off when either of said safety station buttons is first pressed.

8. The apparatus of claim 7 wherein said safety station is hardwired to said controller.

* * * * *